US005886565A

United States Patent [19]

Yasui et al.

[11] Patent Number: 5,886,565

[45] Date of Patent: Mar. 23, 1999

[54] REFERENCE VOLTAGE GENERATING CIRCUIT HAVING AN INTEGRATOR

[75] Inventors: Shoji Yasui; Hideyuki Yamada, both of Hamamatsu, Japan

[73] Assignee: Yamaha Corporation, Hamamatsu, Japan

[21] Appl. No.: 938,460

[22] Filed: Sep. 29, 1997

[30] Foreign Application Priority Data

Sep. 30, 1996 [JP] Japan ..... 8-259477

[51] Int. Cl.[6] ..... G05F 1/10

[52] U.S. Cl. ..... 327/530; 327/538; 327/540

[58] Field of Search ..... 327/341, 344, 327/345, 363, 374, 530, 538, 540, 541, 543; 323/313

[56] References Cited

U.S. PATENT DOCUMENTS

| | | | |
|---|---|---|---|
| 4,264,785 | 4/1981 | Jacobson | 179/6.03 |
| 5,631,598 | 5/1997 | Miranda et al. | 327/540 |
| 5,731,731 | 3/1998 | Wilcox et al. | 327/403 |

*Primary Examiner*—Timothy P. Callahan
*Assistant Examiner*—Jung Ho Kim
*Attorney, Agent, or Firm*—Graham & James LLP

[57] ABSTRACT

A reference voltage generating circuit is provided with a reference voltage output terminal, a voltage dividing circuit that divides a voltage supplied from a power source, and an integrating circuit having a given time constant, for integrating a voltage of the divided voltage output terminal of the voltage dividing circuit and generating a reference voltage as a result of integration to the reference voltage output terminal. A high-speed charging circuit is connected to the reference voltage output terminal, for charging the integrating circuit at a high speed when the power source is turned on, to elevate a voltage of the reference voltage output terminal at a speed higher than a speed determined by the time constant of the integrating circuit. A comparator circuit compares the voltage of the divided voltage output terminal with the voltage of the reference voltage output terminal, and turns off the high-speed charging circuit when a difference between the voltage of the divided voltage output terminal and the voltage of the reference voltage output terminal becomes equal to or smaller than a predetermined level.

5 Claims, 3 Drawing Sheets

4
6
5
1
3
2
VDD
VP
VREF
VN
VP
VBB
VSS
QP1
QP2
QP3
QP4
QP5
QP6
QP7
QP8
QN1
QN2
QN3
QN4
QN5
QN6
QN7
R11
R12
R13
R14
R15
R16
NA
NB
NC
ND
C

REFERENCE VOLTAGE GENERATING CIRCUIT HAVING AN INTEGRATOR

BACKGROUND OF THE INVENTION

1. Field of the Invention

The present invention relates to a reference voltage generating circuit for generating a stable reference voltage with low power consumption, which voltage is suitable for use in an integrated circuit.

2. Prior Art

An example of known reference voltage generating circuit used in an integrated circuit is shown in FIG. 1. This reference voltage generating circuit is comprised of a voltage dividing circuit formed of a series circuit of resistors R51 and R52 provided between a power source VDD and a power source VSS, and a low-pass filter formed of a resistor R53 and a capacitor C. The low-pass filter integrates the output voltage of the voltage dividing circuit to provide a reference voltage output VREF. In order to reduce the power consumption, resistors having large resistance values are used as the voltage dividing resistors R51, R52. The low-pass filter serves to produce a stable reference voltage VREF from the output voltage of the voltage dividing circuit. To this end, the time constants of the resistor R53 and capacitor C are set to large values.

In the reference voltage generating circuit described above, it is necessary to set the time constant of the low-pass filter to be sufficiently large so as to obtain a stable reference voltage VREF. More specifically, a resistor having a large resistance value of 50 kΩ may be used as the resistor R53, and a capacitor having a large capacitance of 22 $\mu$F may be used as the capacitor C. This may cause a problem of a delay in the rise of the reference voltage VREF when the power is turned on. The capacitor C is located outside the integrated circuit, and connected to the interior of the integrated circuit.

Although the rising speed of the reference voltage VREF may be increased by reducing the time constant of the low-pass filter, this would make the reference voltage VREF unstable.

SUMMARY OF THE INVENTION

It is an object of the invention to provide a reference voltage generating circuit which is capable of providing a reference voltage rising at a high speed when the power is turn on, while assuring low power consumption and a stable output characteristic.

To attain the above object, the present invention provides a reference voltage generating circuit provided with a reference voltage output terminal, comprising a power source, a voltage dividing circuit that divides a voltage supplied from the power source, the voltage dividing circuit having a divided voltage output terminal, an integrating circuit having a given time constant, for integrating a voltage of the divided voltage output terminal of the voltage dividing circuit and generating a reference voltage as a result of integration to the reference voltage output terminal, a high-speed charging circuit connected to the reference voltage output terminal, for charging the integrating circuit at a high speed when the power source is turned on, to elevate a voltage of the reference voltage output terminal at a speed higher than a speed determined by the time constant of the integrating circuit, and a comparator circuit that compares the voltage of the divided voltage output terminal with the voltage of the reference voltage output terminal, and turns off the high-speed charging circuit when a difference between the voltage of the divided voltage output terminal and the voltage of the reference voltage output terminal becomes equal to or smaller than a predetermined level.

Preferably, the integrating circuit is a low-pass filter circuit comprising at least a resistor and a capacitor.

More preferably, the high-speed charging circuit comprises a switching device and a resistor connected in series between the power source and the reference voltage output terminal, the switching device, the resistor, and the capacitor of the integrating circuit constituting a second integrating circuit having a time constant smaller than that of the integrating circuit, the second integrating circuit charging the capacitor at a high speed higher than the integrating circuit when the high-speed charging circuit is driven in an on state by the switching device.

Further preferably, the reference voltage generating circuit further comprises a hysteresis providing circuit that sets the predetermined level for comparison with the difference between the voltage of the divided voltage output terminal and the voltage of the reference voltage output terminal by the comparator circuit to a first predetermined value during a rise of the voltage of the reference voltage output terminal, and sets the predetermined level to a second predetermined value that is slightly lower than the first predetermined value during a fall of the voltage of the reference voltage output terminal.

Advantageously, the reference voltage generating circuit further comprises a power-down circuit for cutting off the voltage dividing circuit and the comparator circuit from the power source.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
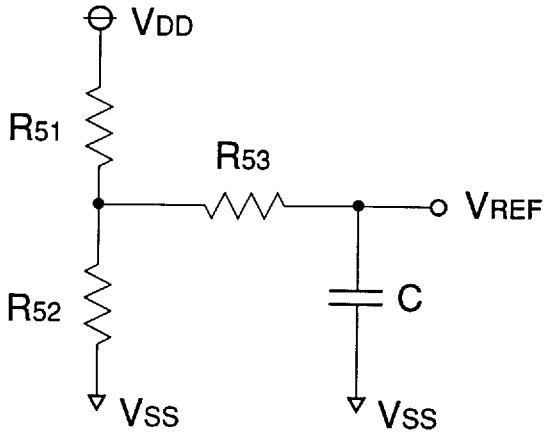
FIG.1 PRIOR ART
FIG. 1 is a circuit diagram showing the configuration of one example of known reference voltage generating circuit.
Figure 2:
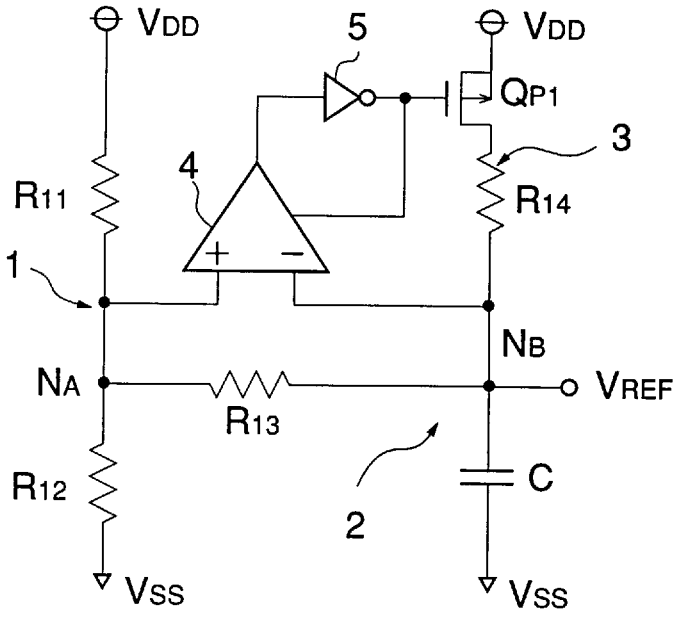
FIG. 2 is a circuit diagram showing the arrangement of a principal part of a reference voltage generating circuit according to an embodiment of the present invention.

FIG. 2 shows a principal part of a reference voltage generating circuit constructed according to one embodiment of the invention. This reference voltage generating circuit is basically comprised of a voltage dividing circuit 1 formed of resistors R11 and R12 connected in series between a power source VDD and a power source VSS, and a low-pass filter formed of a resistor R13 and a capacitor C. The low-pass filter integrates the voltage of an output terminal NA of the voltage dividing circuit 1 to produce a reference voltage VREF at a reference-voltage output terminal NB. In the low-pass filter 2, the resistor R13 has a resistance value of 50 kΩ, and the capacitor C has a capacitance of 22 $\mu$F.

A high-speed charging circuit 3 is provided between the reference voltage output terminal NB and the power source VDD, which has a PMOS transistor QP1 and a resistor R14 connected in series. The time constant of this circuit 3 determined by the ON-state resistance of the transistor QP1, resistance of the resistor R14 and capacitance of the capacitor C is set to be sufficiently smaller than that of the low-pass filter 2. The resistor R14 may be omitted, if required. A comparator 4 is provided for turning on the high-speed charging circuit 3 when the power is turned on, and turning off this circuit 3 when the potential of the reference voltage output terminal NB is elevated to a predetermined level. The comparator 4 compares the voltage of the divided voltage output terminal NA and the voltage of the reference voltage output terminal NB, to detect that a difference between these voltages reaches a predetermined level, and supplies the detection output to a gate of the PMOS transistor QP1 of the high-speed charging circuit 3 via an inverter 5.

In this reference voltage generating circuit, the comparator 4 generates a high level (H) output when the power is turned on, so as to turn on the PMOS transistor QP1 of the high-speed charging circuit 3, so that the capacitor C is charged at a high speed and accordingly the voltage of the reference voltage output terminal NB rises at a high speed toward the voltage of the power source VDD. Then, the comparator 4 generates a low level (L) output when the potential of the reference voltage output terminal NB reaches the voltage level of the divided voltage output terminal NA, so as to turn off the high-speed charging circuit 3. In the present embodiment, the comparator 4 is feedback-controlled by the output of the inverter 5, and is thus given a hysteresis characteristic.

Figure 3:
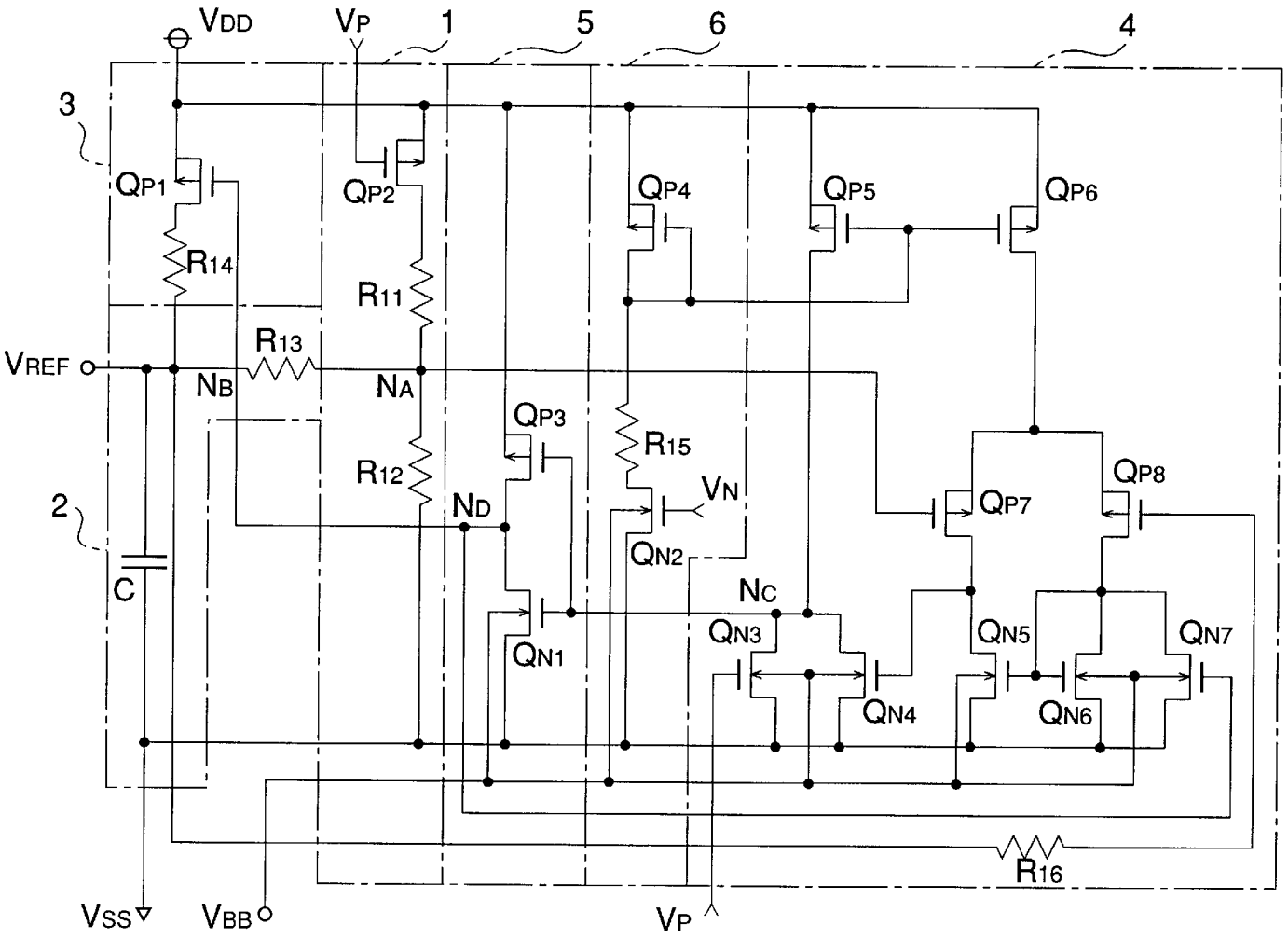
FIG. 3 is a circuit diagram showing in detail the arrangement of the reference voltage generating circuit of FIG. 2.

FIG. 3 shows a detailed construction of the reference voltage generating circuit of the present embodiment. In FIG. 3, the same reference numerals as used in FIG. 2 are used for identifying corresponding elements. The comparator 4 is basically comprised of an active load consisting of NMOS transistors QN5, QN6, and a differential circuit formed of a pair of differential PMOS transistors QP7, QP8 having a common source and connected to a PMOS transistor QP6 as a current source. The voltage of the output terminal NA of the voltage dividing circuit 1 is applied as reference voltage to the gate of the PMOS transistor QP7. The output voltage of the reference voltage output terminal NB to be detected is applied via a resistor R16 to the gate of the PMOS transistor QP8. The output stage of the comparator 4 is formed of an NMOS transistor QN4 and a PMOS transistor QP5 as a current source, and the output of the comparator 4 is connected to the input terminal of the inverter 5 formed of an NMOS transistor QN1 and a PMOS transistor QP3.

A bias circuit 6 for driving the PMOS transistors QP5, QP6 as current sources of the comparator 4 includes a PMOS transistor QP4 and a resistor R15 which cooperate with these transistors QP5, QP6 to constitute a current mirror circuit. In this bias circuit 6 is inserted an NMOS transistor QN2 which serves as a switching device for power-down control. For the same purpose of power-down control, a PMOS transistor QP2 is inserted in the voltage dividing circuit 1 through which steady-state current flows, at a location on the side of the power source VDD. An NMOS transistor QN3 is provided in parallel with the NMOS transistor QN4 in the output stage of the comparator 4.

Figure 4:
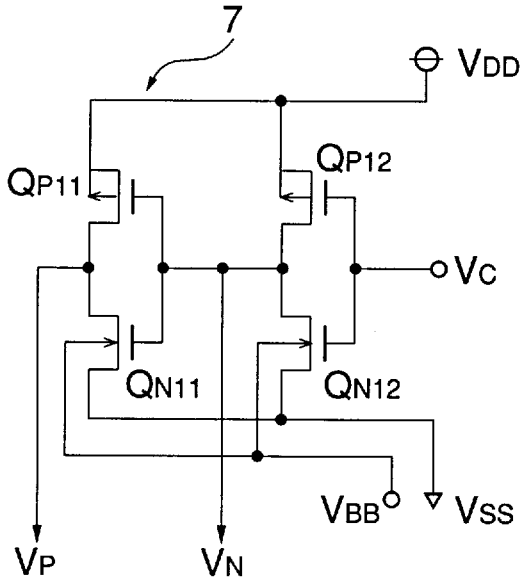
FIG. 4 is a circuit diagram showing the configuration of a power-down control circuit used in the reference voltage generating circuit of FIG. 3.

FIG. 4 shows the construction of a power-down control circuit 7. This control circuit 7 is comprised of a first-stage CMOS inverter which is formed of a PMOS transistor QP12 and an NMOS transistor QN12 and is driven by a control signal VC, and a second-stage CMOS inverter which is formed of a PMOS transistor QP11 and an NMOS transistor QN11 and is driven by the output of the first-stage CMOS inverter. The NMOS transistor QN2 of the bias circuit 6 is controlled and driven by the output VN of the first-stage CMOS inverter, and the PMOS transistor QP2 of the voltage dividing circuit 1 and the output-stage NMOS transistor QN3 of the comparator 4 are controlled and driven by the output VP of the second-stage CMOS inverter.

The comparator 4 of the present embodiment is constructed to be given a hysteresis characteristic, as mentioned above. To this end, an NMOS transistor QN7 is provided in parallel with the NMOS transistor QN6 of the active load, and the gate of this NMOS transistor QN7 is feedback-controlled by the output of the inverter 5. While the operation of this embodiment will be described in detail later, the NMOS transistor QN7 is turned off upon a rise of the potential of the reference voltage output terminal NB, and is turned on upon a fall of the potential of the output terminal NB, so that the reference current value flowing in the active load is switched or changed to thus provide different threshold values.

In the present embodiment, the NMOS transistors QN1–QN7 of respective sections of the circuit of FIG. 3 have source terminals connected to the power source VSS, and bulks connected, separately from the sources, to a substrate bias power source VBB. Thus, noise is prevented by separating the current flowing through the circuit from the current flowing through the bulks. A similar arrangement is employed in the power-down control circuit 7 shown in FIG. 4.

The operation of the reference voltage generating circuit constructed as described above will be explained referring to FIG. 5.

Figure 5:
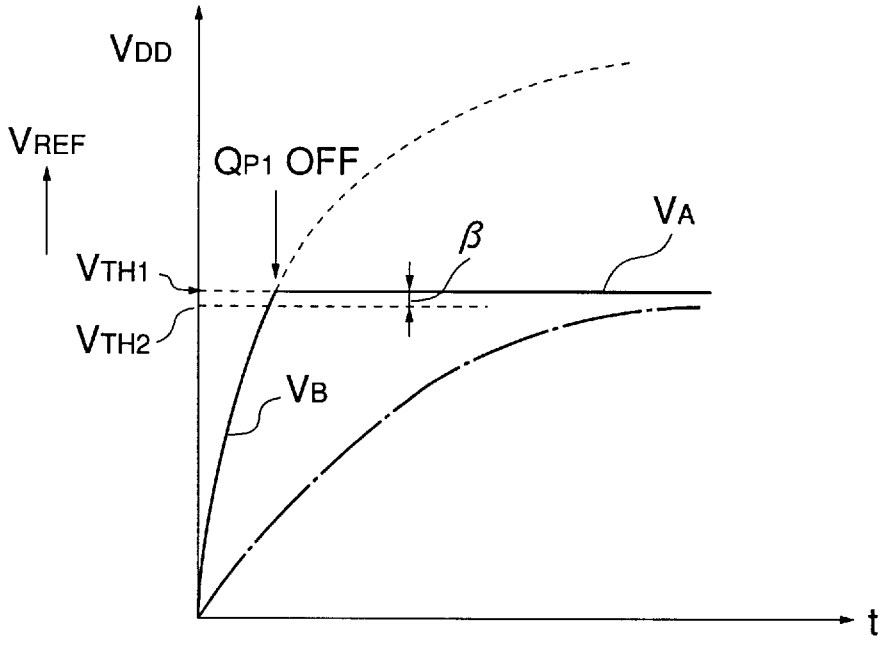
FIG. 5 is a view useful in explaining the operation of the reference voltage generating circuit of FIG. 3.

The power-down control signal VC is normally held at "L" level, and therefore the MOS transistors QP2, QN2 for power-down control in the circuit of FIG. 3 are placed in the ON states, while the MOS transistor QN3 for power down control is placed in the OFF state. When the power is turned on, a divided output voltage VA can be almost instantly obtained at the output terminal NA of the voltage dividing circuit 1 of the resistors R11, R12. In the absence of the high-speed charging circuit 3, the potential of the reference voltage output terminal NB approaches the output voltage VA of the voltage dividing circuit 1, along a charging curve as indicated by a one-dot chain line in FIG. 5 which is determined by the time constant of the low-pass filter 2. In the present embodiment, the reference voltage output terminal NB generates an "L" output (when compared with the output voltage VA of the divided voltage output terminal NA), which is applied to the PMOS transistor QP8 of the comparator 4 immediately after the power is turned on, so that the output terminal NC of the comparator 4 generates an "H" output, and therefore the output terminal ND of the inverter 5 generates an "L" output. As a result, the PMOS transistor QP1 of the high-speed charging circuit 3 is turned on. In this manner, the capacitor C is charged at a high speed by the high-speed charging circuit 3 whose time constant is sufficiently smaller than that of the low-pass filter 2, and accordingly the voltage of the reference voltage output terminal NB rises toward that of the power source VDD, to thereby provide a rapidly rising output voltage VB as shown in FIG. 5.

Immediately after the power is turned on, the NMOS transistor QN7 of the comparator 4 is kept in the OFF state in response to the "L" output of the inverter 5, so that the comparator 4 is provided with a first threshold value VTH1 for inversion of its output level. The first threshold value VTH1 is set to be ideally (substantially) equal to the level of the output voltage VA of the divided voltage output terminal NA, as shown in FIG. 5. When the output voltage VB of the reference voltage output terminal NB reaches the first threshold value VTH1, the output of the comparator 4 is inverted, so that the potential of the output terminal ND of the inverter 5 goes high ("H"), whereby the PMOS transistor QP1 of the high-speed charging circuit 3 is driven into the OFF state, and hence high-speed charging is stopped.

In the above described manner, the reference voltage generating circuit of the present embodiment can provide a reference voltage VREF that rises at a high speed to the output voltage VA of the divided voltage output terminal NA. When the potential of the output terminal ND of the inverter 5 goes high, the NMOS transistor QN7 of the comparator 4 is turned on, so that the current balance of the comparator 4 is changed and hence the threshold value for inversion of the comparator output becomes equal to a second threshold value VTH2 which is lower than the first threshold value VTH1. The second threshold value VTH2 is set to VA-β which is slightly lower than the output voltage VA of the divided voltage output terminal NA, as shown in FIG. 5. Accordingly, even if the reference voltage VREF drops due to discharge of the capacitor C by a load, the output of the comparator 4 is not inverted until the voltage VREF becomes equal to the second threshold value VTH2, and hence the high-speed charging circuit 3 is kept in the OFF state.

Once the reference voltage VREF reaches the output voltage VA of the divided voltage output terminal NA, the voltage dividing circuit 1 and the low-pass filter 2 yield the same effect of providing a stable reference voltage VREF as provided in the know reference voltage generating circuit.

Since the threshold value of the comparator 4 is given hysteresis in the above manner, ringing of the voltage of the reference voltage output terminal NB can be prevented, to obtain a stable reference voltage. In the present embodiment, the high-speed charging circuit 3 is provided for achieving a rapid rise of the reference voltage, thus eliminating the need to reduce the time constant of the low-pass filter 2. This also contributes to stabilization of the reference voltage.

In the present embodiment, the output of the comparator 4 or inverter 5 may be used as a detection signal that informs other circuit(s) that the output of the reference voltage generating circuit has reached a predetermined reference voltage.

If the power-down control signal VC is set to "H" level as needed, "L" level of the control voltage VN and "H" level of the control voltage VP are obtained, whereby the PMOS transistor QP2 of the voltage dividing circuit 1 is turned off, so that this circuit 1 is cut off from the power source VDD. Also, the NMOS transistor QN2 of the bias circuit 6 is turned off, so that the PMOS transistors QP4, QP5, QP6 as current sources of the bias circuit 6 and comparator 4 are turned off, whereby the bias circuit 6 and comparator 4 are also cut off from the power source VDD. Owing to these controls, the steady-state current flowing through the respective portions is restricted, thus enabling power saving.

When the power-down control signal VC is at "H" level, the NMOS transistor QN3 of the comparator 4 is turned on, so that the output of the comparator 4 is short-circuited and hence the output terminal ND of the inverter 5 generates "H" output, to thereby keep the PMOS transistor QP1 of the high-speed charging circuit 3 in the OFF state. This power-down control may be used to turn off the reference voltage generating circuit during a time period in which the operation of this circuit is not needed in the integrated circuit, to thereby reduce redundant power consumption by the integrated circuit as a whole.

What is claimed is:

1. A reference voltage generating circuit provided with a reference voltage output terminal, comprising:

a power source;

a voltage dividing circuit that divides a voltage supplied from said power source, the voltage dividing circuit having a divided voltage output terminal;

an integrating circuit having a given time constant, for integrating a voltage of the divided voltage output terminal of said voltage dividing circuit and generating a reference voltage as a result of integration to said reference voltage output terminal;

a high-speed charging circuit connected to said reference voltage output terminal, for charging said integrating circuit at a high speed when said power source is turned on, to elevate a voltage of said reference voltage output terminal at a speed higher than a speed determined by the time constant of said integrating circuit; and a comparator circuit that compares the voltage of said divided voltage output terminal with the voltage of said reference voltage output terminal, and turns off said high-speed charging circuit when a difference between the voltage of the divided voltage output terminal and the voltage of the reference voltage output terminal becomes equal to or smaller than a predetermined level.

2. A reference voltage generating circuit as claimed in claim 1, wherein said integrating circuit is a low-pass filter circuit comprising at least a resistor and a capacitor.

3. A reference voltage generating circuit as claimed in claim 2, wherein said high-speed charging circuit comprises a switching device and a resistor connected in series between said power source and said reference voltage output terminal, said switching device, said resistor, and said capacitor of said integrating circuit constituting a second integrating circuit having a time constant smaller than that of said integrating circuit, said second integrating circuit charging said capacitor at a high speed higher than said integrating circuit when said high-speed charging circuit is driven in an on state by said switching device.

4. A reference voltage generating circuit as claimed in claim 1, further comprising a hysteresis providing circuit that sets said predetermined level for comparison with said difference between the voltage of the divided voltage output terminal and the voltage of the reference voltage output terminal by said comparator circuit to a first predetermined value during a rise of the voltage of said reference voltage output terminal, and sets the predetermined level to a second predetermined value that is slightly lower than said first predetermined value during a fall of the voltage of said reference voltage output terminal.

5. A reference voltage generating circuit as claimed in claim 1, further comprising a power-down circuit for cutting off said voltage dividing circuit and said comparator circuit from said power source.

* * * * *